US005513844A

United States Patent [19]

Ashcraft et al.

[11] Patent Number: 5,513,844

[45] Date of Patent: May 7, 1996

[54] GOLF CLUB FITTING APPARATUS

[75] Inventors: Danny C. Ashcraft, Vista; Richard E. Parente, San Diego; Richard de la Cruz, Pauma Valley, all of Calif.

[73] Assignee: Goldwin Golf U.S.A., Inc., Carlsbad, Calif.

[21] Appl. No.: 346,427

[22] Filed: Nov. 29, 1994

[51] Int. Cl.[6] ..... A63B 53/02

[52] U.S. Cl. ..... 473/288; 73/65.03; 473/296; 473/306; 473/307

[58] Field of Search ..... 273/77 A, 81.2, 273/81.3, 80 R, 80.1, 167 H, 79

[56] References Cited

U.S. PATENT DOCUMENTS

| | | | |
|---|---|---|---|
| 2,463,053 | 3/1949 | Pritchard | 273/80.1 |
| 3,848,737 | 11/1974 | Kenon | 273/80.1 X |
| 4,655,457 | 4/1987 | Thompson | 273/80.1 X |
| 4,854,582 | 8/1989 | Yamada | 273/80.1 X |
| 4,948,132 | 8/1990 | Wharton | 273/80.1 |

*Primary Examiner*—George J. Marlo
*Attorney, Agent, or Firm*—James C. Weseman; Gray Cary Ware & Freidenrich

[57] ABSTRACT

A golf club fitting apparatus and method utilizes a number of different club heads, the club heads having hosel or shaft receiving bores at different angles and securing devices for releasably securing a hosel at the lower end of a golf club shaft in the bore, and a number of different shafts. The heads have different parameters such as peripheral weighting, center of gravity, and face area in addition to different bore angles. A player can select various different head and shaft combinations to test. To test each combination, the hosel at the end of the shaft is inserted in the bore, and releasably secured in position. The player then tries it out. The shaft is released, and a new combination is tested in the same manner, until an optimum fit for that particular player is found.

8 Claims, 1 Drawing Sheet

GOLF CLUB FITTING APPARATUS

BACKGROUND OF THE INVENTION

The present invention relates generally to golf clubs, and is particularly concerned with a fitting apparatus and method for fitting golf clubs to individual players.

Golf clubs are typically made in a number of different sizes and with variations in other parameters, such as center of gravity position, peripheral weighting, lie angle of the shaft, face or loft angle and face progression. The angle of the shaft relative to the face plate will to some extent determine the loft angle or vertical inclination of the face plate on striking the ball. Clubs are also made with heads and shafts of various different materials. Different players have different requirements as regards all the variable golf club parameters, and purchase of off-the-shelf, pre-made golf clubs in which all the parameters are set does not always provide the ideal match of club to player. Golf clubs may be custom made for each individual player, but this results in a very expensive club.

SUMMARY OF THE INVENTION

It is an object of the present invention to provide a new and improved fitting apparatus and method for golf clubs.

According to one aspect of the present invention, a golf club fitting apparatus is provided which comprises a plurality of club heads having different playing parameters, each head having a front face, upper wall, lower wall, rear wall, a heel portion and a toe, the heel portion having a bore extending inwardly from the upper wall at a predetermined angle, the heads having bores oriented at different angles, and a plurality of different shafts, each shaft having a lower end portion secured in a hosel tube for engaging in the bore of any selected club head, and a releasable securing device for releasably securing the lower end portion of the hosel tube in the bore.

The heel portion of the club head may have a slot extending from an outer surface of the head into the bore, the slot having opposing flat faces, and the releasable securing device may comprise at least one tightening screw extending through a bore extending from an outer surface of the head transverse to the first bore and through one of the slot faces, and into an aligned threaded bore extending inwardly from the other flat face of the slot. The outer surface of the hosel tube is preferably provided with grooves, knurls, or other surface roughening to provide a better gripping engagement with the bore. The hosel tube is inserted in the bore with the tightening screw loose, and the tightening screw is then tightened to draw the opposing flat faces of the slot together and also to reduce the cross sectional dimensions of the bore in which the hosel tube is engaged, retaining the hosel tube and attached shaft secured to the golf club head.

With this arrangement, a player can select a golf club shaft and head combination to try out, releasably secure the shaft to the head, and try a few practice swings to see how the combination feels. The shaft can then be released from the head, and that shaft can be secured to a different head, or the head can be secured to a different shaft, so that the player can try out another combination. Once an ideal fit has been found for a player, a golf club can be made to match the selected head and shaft combination.

This fitting apparatus will be less expensive than a custom made golf club, but at the same time will allow better fitting to individual player's preferences than selection from off-the-shelf clubs. The number of different golf clubs which must be stocked by stores, manufacturers and distributors is reduced with this apparatus, since a large number of different heads and shafts can essentially be provided for selective combination. The heads and shafts are easily interchangeable, providing a very large number of different combinations for testing. The heads and shafts can be mixed and matched until the player finds the best combination.

Preferably, the club head has an additional bore extending from the lower wall in alignment with the first mentioned bore, and has an end wall with an opening connecting the additional bore with the first bore. The hosel tube preferably has a solid end portion having a threaded bore. A safety screw may be mounted in the additional bore with the threaded shaft of the screw extending through the opening between the two bores and into the threaded bore at the end of the hosel tube. This provides additional security against the golf club head accidentally becoming separated from the shaft while a player is trying out the combination.

According to another aspect of the present invention, a golf club fitting method is provided, which comprises the steps of selecting one of a plurality of different golf club heads having shaft receiving bores at different angles, selecting one of a plurality of different golf club shafts, engaging the end of the shaft in the bore in the selected head, releasably securing the shaft in the bore, testing the head and shaft combination, releasing the shaft from the bore, and repeating the selection, securing and testing steps until a preferred golf club shaft and head combination is found. At this point, a golf club can be made to match the selected and tested shaft and head combination, at less expense than comparable custom-made golf clubs.

Different golf players have different physical sizes, playing characteristics and skill levels, and each player would prefer to select a golf club matching their particular requirements. The golf club fitting apparatus and method of this invention allows a player to try out a large number of different head and shaft combinations quickly and easily without having to stock a large variety of finished golf clubs. The player can mix and match shafts and heads easily until the optimum combination is found. This provides far greater variation than is normally provided in the stock of finished, off-the-shelf golf clubs in a store, and at less expense than making a custom golf club from scratch.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
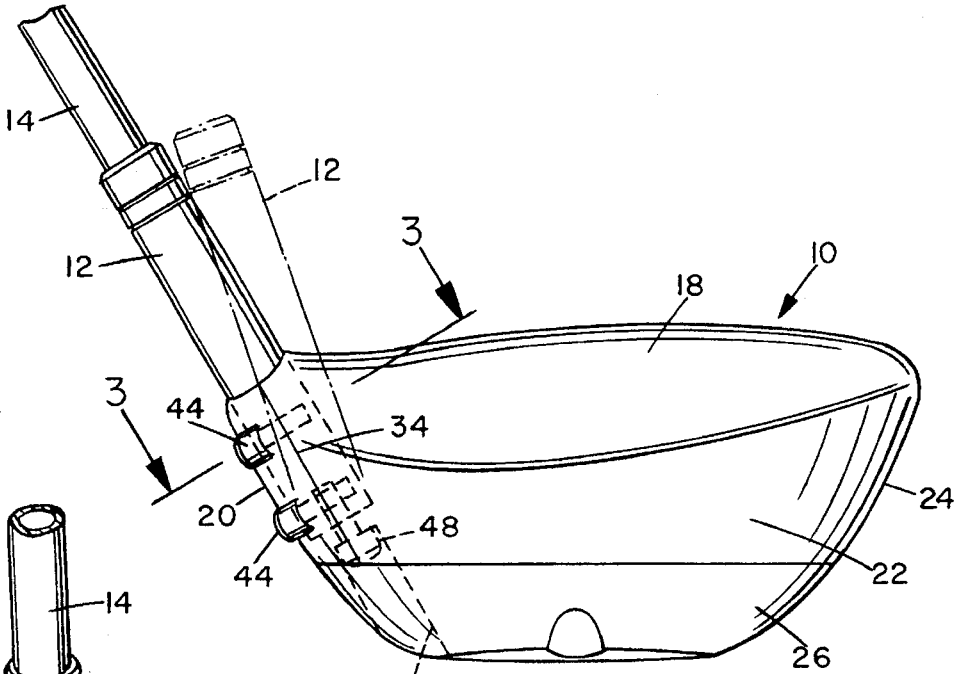
FIG. 1 is a rear view of a typical golf club head incorporating the fitting structure according to a preferred embodiment of the invention.

FIGS. 1–4 of the drawings illustrate a golf club fitting apparatus according to a preferred embodiment of the invention. The apparatus basically comprises a golf club head 10 of the metal wood type, and a hosel tube 12 releasably secured to the head 10 with a shaft 14 secured in the hosel tube by means of adhesive or the like. The head and hosel tube are preferably similar to the golf club head described in our co-pending application Ser. No. 08/270,920 entitled "Golf Club Head," filed Jul. 5, 1994, the contents of which are incorporated herein by reference.

Head 10 has a front, striking face 16, an upper wall or crown 18, heel portion 20, rear wall 22, toe 24 and sole plate 26. The sole plate 26 is preferably formed separately from the remainder of the head and secured to the head by any suitable means such as bonding, welding, screw fasteners or the like. The head 10 has an internal cavity 28, and the heel portion 20 is relatively thick. A first, blind bore 30 extends inwardly into the solid material of heel portion 20 at a predetermined angle to the front face of the head, and terminates at inner end 32 spaced from the cavity 28. Bore 30 is dimensioned to receive hosel tube 12 and therefore determines the orientation of shaft 14. The angle of the bore 30 thus determines the lie angle, or the angle of shaft 14 relative to the sole of the club head.

Hosel 12 is a tubular member of stainless steel or the like and has an internal diameter slightly greater than the outer diameter of shaft 14, so that the end of shaft 14 can be received in hosel 12 and secured by welding, adhesive bonding or the like. The end portion of the hosel 12 has surface roughening 33 on its outer surface, in the form of grooves, knurls or other surface projections or depressions, and the roughened portion 33 is designed to fit in bore 30.

Figure 2:
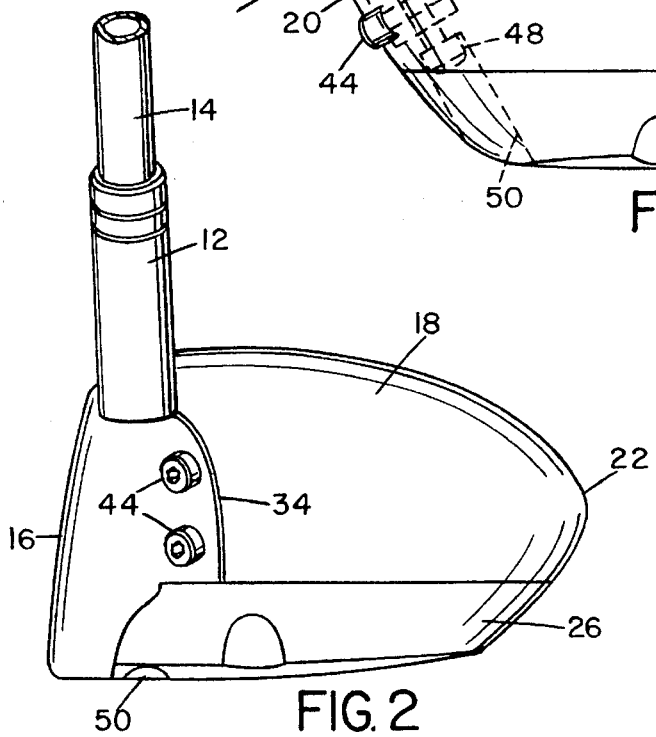
FIG. 2 is a side view from the left-hand side of FIG. 1.
Figure 3:
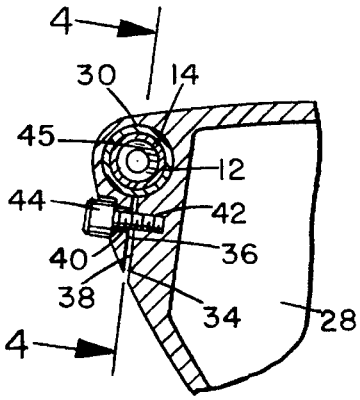
FIG. 3 is a sectional view taken on line 3—3 of FIG. 1.
Figure 5:
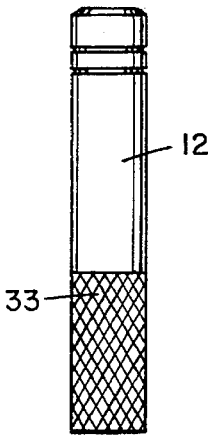
FIG. 5 is a side view of the special hosel.

Head 10 has a transverse slit 34 extending from the outer surface of the head adjacent the bore 30 and inwardly to intersect the bore, as best illustrated in FIGS. 2 and 3. Slit 34 is cut to form opposing flat faces 36, 38 extending into the heel portion 20 of the head. A pair of through bores 40 extend from the heel end transversely through flat face 36, and bores 40 are aligned with threaded blind bores 42 in the opposing flat face 38. A pair of clamping screws 44 each extend through one of the bores 40 across slit 34 for threaded engagement with the respective aligned bore 42. Tightening of screws 44 acts to draw the opposing flat faces 36,38 towards one another and reduces the periphery or circumference of the first bore 30. Thus, a hosel 12 can be inserted in bore 30 with the screws loosened, and the screws can then be tightened to releasably clamp the hosel in the bore, as best illustrated in FIG. 3. When the clamping screws 44 are tightened, the surfaces of bore 30 will be in close engagement with the roughened surface 33 of the hosel, thus resisting movement of the hosel out of the bore.

Figure 4:
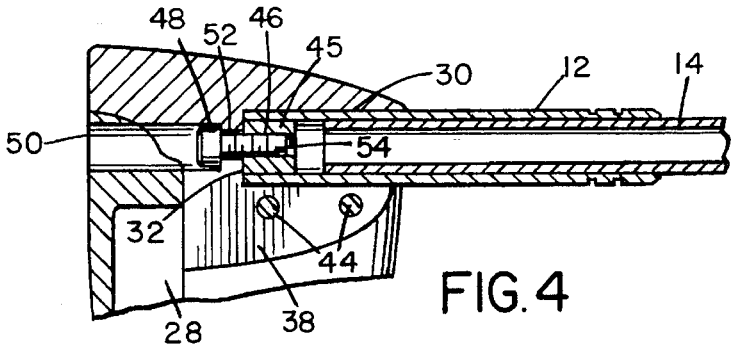
FIG. 4 is a sectional view taken on line 4—4 of FIG. 3.

The lower end of the hosel has a solid end wall or plug 45 in which a threaded bore 46 is provided for threaded engagement with an additional safety screw 48 for added security against accidental dislodging of the hosel from bore 30, as best illustrated in FIG. 4. A through bore 50 extends through sole plate 26 and part of the heel portion 20 in alignment with bore 30, and has a reduced diameter portion 52 connecting bore 50 with the end 32 of the bore 30. Safety screw 48 is inserted through bore 50 with threaded shaft portion 54 extending through portion 52 into the threaded bore 46 in hosel 12.

Although the additional safety screw 48 is preferably provided for additional security, it may be eliminated along with bore 50 and the solid end plug 45 of hosel 12 in alternative embodiments. In that case, the hosel and attached shaft are releasably secured in the bore 30 only by means of clamping screws 44 for tightening bore 30 around the roughened portion of the hosel. In another alternative, the clamping screws 44 and slit 34 may be eliminated and the hosel may be secured by safety screw 48 only, or by one or more screws extending transversely into bore 30 and into aligned bores or holes in the walls of hosel 12 and shaft 14.

This arrangement allows shaft 14 to be releasably secured in the bore 30 in head 10. Although in the preferred embodiment, the end of shaft 14 is releasably secured in a separate hosel tube 12 for added strength, and tube 12 is secured in bore 30, in alternative embodiments shaft 14 may be made in one piece and the end of shaft 14 itself may be secured directly in bore 14. The apparatus will include a plurality of heads 10 and shafts 12 of different parameters, which can be selectively secured together for testing of a very large number of different head and shaft combinations.

Preferably, the fitting apparatus will include a set of heads 10 and shafts 14. Each head 10 will have a bore 30 and clamping screws 44 and safety screw 48 as described above for releasably securing a selected shaft 14 in bore 30. The heads will have bores at different angles corresponding to a range of different lie or shaft angles. Preferably, bores are provided for lie angles in the range from 54 to 58. FIG. 1 illustrates one alternative bore orientation and the resultant orientation of hosel 12 in dotted outline. Additionally, heads will be provided in different sizes and weights, and with other different parameters. Heads will be provided with different peripheral weighting, as described in our co-pending application Ser. No. 08/270,921 filed Jul. 5, 1994. Heads will be provided in different overall sizes, such as the shallow, standard and deep heads as described in our co-pending application Ser. No. 08/270,921 referred to above. Head sizes in the range from 194 c.c. to 300 c.c. may be provided, for example. Heads are also provided with different lofts, in the range from 7 to 12 degrees, for example. Heads will also be provided with different face angles, for example a typical set may include the following face angles: 4 closed, 3 closed, 2 closed, 1 closed, square, 1 open, 2 open, 3 open, 4 open. Head weight will also be varied. Heads will be provided in the weight range of 185–190 grams, 191–195 grams, 196–200 grams, 201–205 grams. Additionally, heads with different face specifications (roll and bulge as measured in inches) will preferably be provided. A typical set may include the following face specifications in different heads: 10×10, 10×14, 11×14, 12×14, 13×14. Different combinations of the above parameters will be provided in different heads. The number of heads in a set will depend on the application. Typically, a smaller set of heads with less variation will be needed for amateur players than for professional golfers. The variation in loft, lie or face angle from one head to the next in a set may be anything from 0.01 to 1, with a finer variation being provided for professional players who will be more sensitive to fine differences than an amateur.

A set of different shafts will also be provided in the apparatus. Shafts will be provided in different lengths, typically from 42" to 45", and in different materials, such as graphite, titanium, steel, aluminum, and composite material. Shafts of each material and length will also be provided with different kick points, either high, low, or mid-length, and with different flex, L, A, R, F, S, and X.

This apparatus provides a fitting system for allowing golfers to select from an extremely large variety of different head and shaft combinations without needing the manufacturer or distributor to actually stock the entire range of different combinations. This system may also be used for golf club developmental testing purposes, to find the ideal shaft for a newly developed head, for example.

The fitting method using the apparatus of FIGS. 1–5 will now be described in more detail. The player first selects a shaft 14 and one of the heads 10 to try out. The selected shaft is releasably secured to the selected head by inserting hosel tube 12 into bore 30, and tightening screws 44 as well as safety screw 48 if used. The angle of bore 30 will determine the angle of shaft 14 relative to the head, and thus the lie and loft angles. Different heads will also be provided with different size face plates, different peripheral weighting, different center of gravity positions producing varying gear effects, and so Once a selected shaft has been secured to a selected head, the player can try a few practice swings to obtain a feel for the particular combination. The shaft 14 is then released by loosening screws 44 and removing screw 48 via bore 50. The same shaft may then be secured to a different head, or the same head may be secured to a different shaft, or a completely new shaft and head combination may be selected to test. The procedure may be repeated as many times as necessary until the player finds an optimum combination of head and shaft. A golf club is then manufactured for the player to match the selected combination, except that the head in the manufactured club will have no slit 34, bore 50, or screws 44 and 48, and the hosel will be permanently secured in the hosel receiving bore. The end plug 45 will also not be needed in the hosel of the manufactured club.

The heads and shafts of this invention are easily interchangeable. The combinations available for possible testing are numerous, and significantly greater than the number of different finished clubs which could be stocked by a distributor. This fitting apparatus and method will therefore greatly reduce the stocking needs of both manufacturers and distributors, while at the same time will enable the golfer to custom select a club and shaft combination by fully testing a large number of different possible combinations before selecting the best match to that particular golfer's style. This system will assist in properly fitting players of all levels from the touring professional to the amateur, and will save time over more conventional assembly and fitting methods.

The same basic fitting apparatus and method can be used for other types of golf club, not only the hollow metal wood head as illustrated in the drawings. All that is needed is a set of different heads of the desired general type, each head having a hosel receiving bore, with the heads having different parameters and different bore angles, and a set of different shafts for releasably securing in the bores of selected heads.

Although a preferred embodiment of the invention has been described above by way of example only, it will be understood by those skilled in the field that modifications may be made to the disclosed embodiment without departing from the scope of the invention, which is defined by the appended claims.

We claim:

1. A golf club fitting apparatus, comprising:

a plurality of different golf club heads;

each club head having an outer surface comprising a front face, a rear wall, an upper wall, a lower wall, a heel and a toe;

the head having a bore extending inwardly from said upper wall adjacent said heel at a selected angle, the club heads including heads having bores at different angles relative to the club head;

at least one hosel tube having a lower end portion for engagement in the bore in a selected head;

a golf club shaft having a lower end portion secured in said hosel tube; and each of said heads including a releasable securing device adapted to releasably secure the lower end portion of the hosel tube in the bore of the selected head.

2. The apparatus as claimed in claim 1, wherein the lower end portion of the hosel tube has a roughened surface.

3. The apparatus as claimed in claim 1, including a plurality of different golf club shafts secured to hosel tubes for selective connection to a selected head.

4. The apparatus as claimed in claim 1, wherein each hosel bore has an adjustable periphery and the securing device comprises at least one clamping screw for reducing the periphery of said bore to grip the lower end portion of an inserted hosel tube.

5. The apparatus as claimed in claim 4, wherein each hosel bore has a transverse slit projecting outwardly from the bore to the outer surface of said head, said slit having opposite flat faces, and the head has a second bore extending from said outer surface transverse to said slit through one of said flat faces for receiving said clamping screw and a third, threaded bore extending from said second flat face in alignment with said second bore for threaded engagement with said clamping screw to draw the flat faces together and reduce the periphery of said first bore.

6. The apparatus as claimed in claim 5, wherein the securing device comprises two clamping screws, the head having a pair of parallel bores extending from the outer surface transverse to said slit through one of said flat faces for receiving said clamping screw and a pair of threaded bores in said second flat face, each threaded bore being in alignment with a respective one of said parallel bores for threaded engagement with a respective one of said clamping screws.

7. The apparatus as claimed in claim 1, wherein the lower end portion of said hosel tube has a solid end plug having a threaded bore, said head having a through bore extending from the lower wall in alignment with said first bore and communicating with the lower end of said first bore, and said securing device comprises a retaining screw in said through bore for releasable threaded engagement in the bore in the end plug of a hosel tube in said first bore to hold the hosel tube in said bore.

8. The apparatus as claimed in claim 4, wherein said club head comprises a body having a downwardly facing recess and a separate sole plate secured in said recess forming the lower wall of said head, the body having a slit extending from an outer surface between said recess and said upper wall and transversely into said bore, said slit having opposing flat faces and said releasable securing device comprises at least one clamping screw to draw said faces together and reduce the periphery of said bore.

* * * * *